US006064008A

United States Patent [19]

Craton

[11] Patent Number: 6,064,008

[45] Date of Patent: May 16, 2000

[54] CONDUCTOR INSULATED WITH FOAMED FLUOROPOLYMER USING CHEMICAL BLOWING AGENT

[75] Inventor: Gary L. Craton, Newton, N.C.

[73] Assignee: CommScope, Inc. of North Carolina, Hickory, N.C.

[21] Appl. No.: 08/799,777

[22] Filed: Feb. 12, 1997

[51] Int. Cl.[7] ..... H01B 7/00

[52] U.S. Cl. ..... 174/110 FC; 174/113 R

[58] Field of Search ..... 174/110 FC, 110 PM, 174/110 F, 113 R, 121 A

[56] References Cited

U.S. PATENT DOCUMENTS

| | | | |
|---|---|---|---|
| 3,953,566 | 4/1976 | Gore . | |
| 4,304,713 | 12/1981 | Perelman . | |
| 4,394,460 | 7/1983 | Chung et al. . | |
| 4,543,368 | 9/1985 | Smearing et al. | 521/90 |
| 4,711,811 | 12/1987 | Randa . | |
| 4,716,073 | 12/1987 | Randa . | |
| 5,032,621 | 7/1991 | Buckmaster et al. | 521/85 |
| 5,210,377 | 5/1993 | Kennedy et al. | 174/110 F X |
| 5,401,334 | 3/1995 | O'Melia et al. | 148/265 |
| 5,483,020 | 1/1996 | Hardie et al. . | |
| 5,493,071 | 2/1996 | Newmoyer | 174/113 R |
| 5,514,837 | 5/1996 | Kenny et al. | 174/113 R |
| 5,554,236 | 9/1996 | Singles et al. . | |
| 5,576,515 | 11/1996 | Bleich et al. | 174/110 FC X |
| 5,614,319 | 3/1997 | Wessels et al. | 428/379 |
| 5,619,016 | 4/1997 | Newmoyer | 174/113 R |
| 5,670,244 | 9/1997 | Taylor et al. | 428/213 |
| 5,741,855 | 4/1998 | Kaduk et al. | 525/88 |
| 5,776,343 | 7/1998 | Cullen et al. | 210/483 |

OTHER PUBLICATIONS

"Expandex® 175—Developmental High Temperature Chemical Foaming Agent", Celogen® Foaming Agents, Product Information Brochure of Uniroyal Chemical Company, Oct. 27, 1994, BROCH2EXP175.

Technology of Celogen® Blowing Agents, Brochure of Uniroyal Chemical Company, Inc., Middlebury, Connecticut, Aug. 1992.

*Primary Examiner*—Kristine Kincaid
*Assistant Examiner*—Chau N. Nguyen
*Attorney, Agent, or Firm*—Alston & Bird LLP

[57] ABSTRACT

A communications cable is provided having at least one elongate electrical conductor surrounded by a layer of insulating material, said layer including a chemically blown fluorinated polymer having a melting point of greater than about 480° F. The elongate electrical conductors may be provided as at least one pair of twisted wires, each wire thereof surrounded by a layer of insulating material including the chemically blown fluorinated polymer. The fluorinated polymer is preferably a high melting fluorinated polymer and is chemically blown by a blowing agent such as the barium salt of 5-phenyltetrazole. The communications cable includes insulated wires which possess a layer of foamed fluorinated polymer insulating material having uniform thickness and electrical properties along the length of the wire. The fluorinated polymer can be applied on the conductor in a relatively thin layer which minimizes the amount of fluorinated polymer material used to insulate the individual conductors.

19 Claims, 1 Drawing Sheet

CONDUCTOR INSULATED WITH FOAMED FLUOROPOLYMER USING CHEMICAL BLOWING AGENT

FIELD OF THE INVENTION

The present invention relates broadly to flame retardant communication cables and more particularly, to flame retardant communications cable containing at least one twisted pair of fluorinated polymer insulated wires.

BACKGROUND OF THE INVENTION

Insulated wires such as those used in communications cable often include flame retardant insulating materials. In communications cables, these insulated wires are often provided as twisted pairs consisting of two insulated conductors twisted about each other to form a two conductor group. The flame retardant insulating materials used with these cables allow them to be located in the plenum of buildings or in other locations where flame retardance and low smoke generation are important properties for the cable.

The flame retardant insulating materials conventionally used with insulated wires include fluorinated polymers such as fluorinated ethylenepropylene (FEP), ethylenetrifluoroethylene (ETFE), and ethylenechlorotrifluoroethylene (ECTFE). Although the fluorinated polymers used as insulation impart the necessary flame retardant properties to the plenum cable, these polymers are generally quite expensive. Therefore, it is desirable to minimize the amount of insulated material used for surrounding the conductors, as for example, by applying a relatively thin layer of the insulating material.

It is also often desired to foam the polymer insulating material. Foamed insulating materials can further minimize the quantity of polymer required while improving the electrical transmission characteristics of the resulting cable. The insulating materials are commonly foamed with a gas blowing agent such as nitrogen or carbon dioxide. However, there are problems associated with foaming the insulating polymer material with gas blowing agents. In particular, where thin insulating layers are employed, small variations in the process conditions in applying the insulating material to the conductor can result in disproportionately large changes in the characteristics of the foamed polymer. For this reason it is difficult to maintain close manufacturing tolerances for density, thickness, dielectric constant, etc. This is particularly a problem at the high temperatures used to melt the fluorinated polymers. As a result, it is difficult to provide wires having a layer of foamed fluorinated polymer insulating material with uniform or consistent properties along the length of the wire. Therefore, the electrical properties of the cable suffer.

SUMMARY OF THE INVENTION

In accordance with the present invention, a communications cable is provided having at least one elongate electrical conductor surrounded by a layer of insulating material comprising a foamed high-melting fluorinated polymer, said foam having been formed through the thermal decomposition of an agent commonly referred to as a "chemical blowing agent" or "CBA". Foam compositions produced with the use of a chemical blowing agent are commonly referred to as "chemically blown" foam compositions. Generally, the elongate electrical conductors are provided as at least one pair of twisted wires, each wire thereof surrounded by a layer of the chemically blown fluorinated polymer insulating material.

In the communications cable of the present invention, the fluorinated polymer is a high-melting fluorinated polymer having a melting point of greater than about 480° F. Suitable high-melting fluorinated polymers include fluorinated ethylene-propylene (FEP), perfluoroalkoxypolymers (PFA's), and mixtures thereof. Exemplary PFA's include copolymers of tetrafluoroethylene and perfluoropropylvinylether and copolymers of tetrafluoroethylene and perfluoromethylvinylether (MFA copolymers or MFA's). The fluorinated polymer insulating material is foamed by a chemical blowing agent, and the resulting product will contain residual decomposition products of the chemical blowing agent. The preferred chemical blowing agent is a barium salt of 5-phenyltetrazole. When used to chemically blow the fluorinated polymer, the barium salt of 5-phenyltetrazole evolves nitrogen gas at the elevated extrusion temperatures thereby producing a foamed insulation layer. The residual decomposition product of the blowing agent present in the foamed insulating material includes barium. The cable may further include at least one additional pair of twisted wires, wherein each wire comprises a conductor surrounded by a layer of non-fluorinated insulating material. The twisted pairs of insulated wire may be provided in a jacket which surrounds and protects the wires from the environment.

The present invention also provides a method of making a communications cable having flame retardant properties comprising the steps of blending a fluorinated polymer with a chemical blowing agent, heating the blend of the fluorinated polymer and the chemical blowing agent to a predetermined temperature above the melting point of the fluorinated polymer and the decomposition temperature of the chemical blowing agent, extruding a metered amount of the heated blend around an advancing electrical conductor and allowing the blend to foam and expand to a thickness of less than 25 mil to produce an insulated conductor with a chemically blown fluorinated polymer insulation. A twisted pair of the insulated conductors may then be formed from two of the conductors and a jacket formed around the twisted pair to form a communications cable. The amount of the chemical blowing agent blended with the fluorinated polymer may preferably range between about 0.05% and 1.0% by weight.

The layer of foamed fluorinated polymer insulating material surrounding the conductor can be applied in a relatively thin layer (less than about 25 mils) and has excellent uniformity of thickness and uniformity of electrical properties along the length of the wire. Further, the foamed fluorinated polymer insulation provides a cable having a high velocity of propagation which can meet very close manufacturing tolerances. The insulated wire can be produced at high throughput.

BRIEF DESCRIPTION OF THE DRAWINGS

Other features and advantages of the present invention will become apparent from the following detailed description of the invention taken in conjunction with the drawings, in which.

DETAILED DESCRIPTION OF THE PREFERRED EMBODIMENTS

Figure 1:
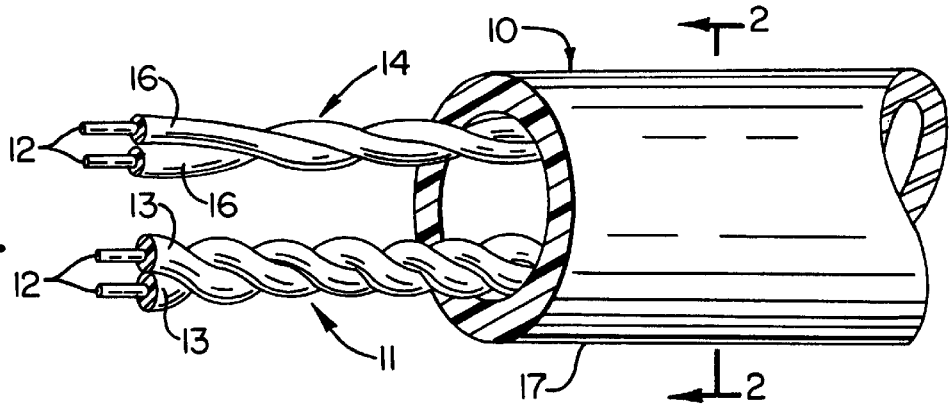
FIG. 1 is a perspective view of a cable according to a preferred embodiment of this invention having two pairs of twisted wires.

Referring now to FIG. 1, there is shown a multi-pair communications cable designated generally by having two pairs of twisted wires. A first pair of twisted wires 11 is comprised of conductors 12 each surrounded by a layer of a first insulating material 13. A second pair of twisted wires 14 comprises conductors 12 and are surrounded by a layer of a second insulating material 16. The second insulating material may be the same as the first insulating material or, if desired, may be a different insulating material. The conductors 12 may be a metallic wire of any of the well-known metallic conductors used in wire and cable applications, such as copper, aluminum, copper-clad aluminum, and copper-clad steel. Preferably, the wire is 18 to 26 AWG gauge. As shown most clearly in FIG. 2, the two pairs of twisted wires 11 and 14 may be enclosed in an insulating jacket 17 to form the multi-pair cable 10.

The layer of a first insulating material 13 is a chemically blown fluorinated polymer therefore providing a cable 10 having excellent flame retardant properties and low smoke generation. The fluorinated polymer used in the layer 13 is preferably a high melting fluorinated polymer having a melting point of greater than about 480° F. Suitable high melting fluorinated polymers include fluorinated ethylenepropylene (FEP), perfluoroalkoxypolymers (PFA's), and mixtures thereof. Exemplary PFA's include copolymers of tetrafluoroethylene and perfluoropropylvinylether (e.g. Teflon PFA 340) and copolymers of tetrafluoroethylene and perfluoromethylvinylether (MFA copolymers which are available from Ausimont S.p.A.). The layer 13 of the fluorinated polymer insulating material has a thickness of less than about 25 mil, preferably of less than about 15 mil, and for certain applications even less than about 10 mil.

The layer of a first insulating material 13 is foamed or expanded using a chemical blowing agent. Chemical blowing agents are compounds which decompose at elevated temperatures to form a gas, e.g., nitrogen or carbon dioxide, and other decomposition products. The chemical blowing agent used in the present invention decomposes at a temperature above the temperature needed to melt the fluorinated polymer and the gas evolved from the chemical blowing agent foams or expands the polymer. The polymers foamed by the chemical blowing agent typically will contain residual amounts of the decomposition products of the chemical blowing agent and these decomposition products therefore may be used as a tell-tale indicator that the foamed polymer has been chemically blown. Depending on the particular chemical blowing agent used, various residual decomposition products may be present in the foamed polymer. A particularly suitable chemical blowing agent is the barium salt of 5-phenyltetrazole which decomposes above about 680° F. and is available from Uniroyal Chemical Company as Expandex 175. The barium salt of 5-phenyltetrazole decomposes to evolve nitrogen gas and to form barium and substituted heterocyclic compounds as residual decomposition products. In particular, barium has a large x-ray cross-section and its presence in the foam may be easily detected by conventional analytical techniques.

In addition to the fluorinated polymer and the chemical blowing agents, other additives may be used in the layer 13 to enhance the material compatibility and processing of the mixture. The insulating composition may also optionally contain suitable additives, such as pigments, additional nucleating agents, thermal stabilizers, acid acceptors and processing aids.

The layer of a second insulating material 16 may be a high melting fluorinated polymer as described above, a low melting fluorinated polymer (e.g. ethylenetrifluoroethylene (ETFE) or ethylenechlorotrifluoroethylene (ECTFE)), or a non-fluorinated material such as a polyolefin. Polyolefins such as polyethylene and polypropylene may be used to reduce the cost of the cable but do not enhance the flame retardance of the cable 10. The layer 16 may also be foamed to reduce the amount of material necessary for insulating the conductors 12. The layer of a second insulating material 16 may contain conventional additives as described above and if desired may further contain a flame retardant composition such as antimony oxide. Generally, the second insulating material is selected along with the first insulating material to provide a cable 10 which meets the flame and smoke standards for plenum cable set forth in Underwriter's Laboratory Standard 910 entitled "Test Method For Fire and Smoke Characteristics of Cables Used in Air-Handling Spaces".

Figure 2:
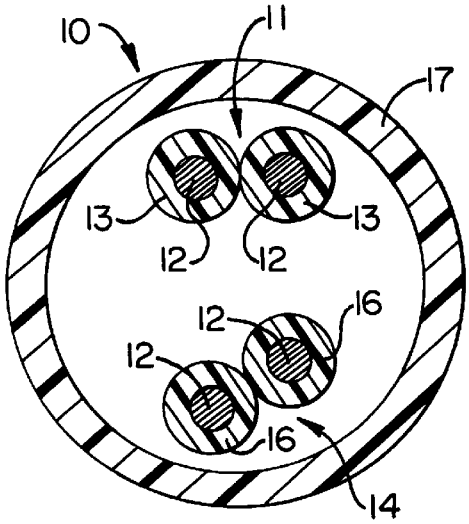
FIG. 2 is a cross-sectional view of the cable of FIG. 1 taken along lines 2—2 illustrating two pairs of twisted wires having solid insulating materials.

The assembly of multi-pairs of twisted wires is referred to as a cable core. Although, FIGS. 1 and 2 illustrate a cable 10 comprising two pairs of twisted wires, it will be understood by one skilled in the art that the cable may contain more than two pairs of twisted wires. As illustrated, a jacket 17 preferably surrounds the insulated conductor 12. The jacket is typically formed of a material suitable for plenum cable use such as a fluorinated polymer, polyvinylchloride, or a polyvinylchloride alloy.

The wires forming the insulated pair for the flame retardant communications cable are made by covering the individual conductors with a layer of insulating material. The fluorinated polymer used as the insulating material is blended with an effective amount of the chemical blowing agent. The term "effective amount of blowing agent" is used to indicate a sufficient amount of blowing agent to cause initial cells to form within the mixture. Generally, there is between about 0.05% and about 1.0% by weight of the chemical blowing agent present in the mixture. Preferably, there is from about 0.1% to about 0.5% by weight. Because the chemical blowing agent is generally in solid form, it is easy to control the amount blended with the fluorinated polymer which directly affects the properties of the foamed polymer as described below. The chemical blowing agent is generally blended with the fluorinated polymer pellets prior to melting of the fluorinated polymer. For example, the chemical blowing agent may be compounded with the fluorinated polymer or with a compatible lower-melting polymer, or coated onto the fluorinated polymer pellets, to form masterbatch pellets. The masterbatch pellets may then be added to the extruder apparatus along with unmodified fluorinated polymer pellets to provide the desired concentration of chemical blowing agents in the fluorinated polymer melt.

The fluorinated polymer and chemical blowing agent are heated in a suitable apparatus such as a crosshead extruder apparatus to a predetermined temperature above the melting point of the fluorinated polymer sufficient to activate the chemical blowing agent. Preferably, the fluorinated polymer and the chemical blowing agent are heated to between about 680° F. and 730° F. Generally, the amount of chemical blowing agent and the temperature of the melt determine the characteristics of the insulating material, and specifically the dielectric constant of the insulating material and the corresponding velocity of propagation of the conductor. The higher the temperature and the higher the concentration of the chemical blowing agent, the more gas is evolved and thus the lower the dielectric constant of the insulation and the higher the velocity of propagation of the conductor.

Once the fluorinated polymer and the chemical blowing agent are heated to above the melting point of the fluorinated polymer and above the decomposition temperature of the chemical blowing agent, the melt is extruded onto individual conductors in the extruder apparatus. At least one layer of the fluorinated polymer is applied around the conductor in the extruder apparatus. The conductor is then passed from the extruder apparatus through a die to the atmosphere thus causing the fluorinated polymer to expand and form the foamed layer of insulating material 13. The fluorinated polymer expands at least about 10% by volume and may expand more than 20% by volume, or even more than about 40% by volume once it exits the extruder apparatus.

The chemical blowing agents used in the present invention have been determined to be especially advantageous for use with fluorinated ethylenepropylene (FEP) and enables production of FEP insulated conductors at higher speeds than heretofore possible. Specifically, in conventional processes, attempts to increase the throughput of FEP from the extruder apparatus has resulted in melt fracture because of the high critical shear rate of the FEP melt. However, using the chemical blowing agents of the present invention, the FEP melt can be extruded at a faster rate without causing melt fracture, thereby increasing the production rate of the insulated cable.

The flame retardant communication cables of the invention include insulated wires which possess a layer of foamed fluorinated polymer insulating material having uniform thickness and uniform electrical properties along the length of the wire. The fluorinated polymer can be applied on the conductors in a relatively thin layer (less than about 25 mils) which minimizes the amount of fluorinated polymer material used to insulate the individual conductors. The decreased amount of fluorinated polymer material results in reduced smoking of the cable material when exposed to flame. Because chemical blowing agents are used, it is possible to adjust the dielectric constant of the insulating material and the foamed fluorinated polymer. Further, the foamed fluorinated polymer insulation provides a cable having a higher velocity of propagation than conventional plenum cables. The process of the invention increases the rate at which the insulated wire is produced. The resulting cable is smaller and therefore more easily fits in conduit when used in such applications.

What is claimed is:

1. A communications cable comprising at least one elongate electrical conductor surrounded by a layer of insulating material, said insulating material comprising a chemically blown fluorinated polymer having a melting point of greater than about 480° F. and residual decomposition products of a 5-phenyltetrazole salt.

2. The communications cable according to claim 1 wherein said layer of insulating material has a thickness of less than about 25 mil.

3. The communications cable according to claim 2 wherein the thickness of said layer of insulating material is less than about 15 mil.

4. The communications cable according to claim 1 wherein said fluorinated polymer is selected from the group consisting of fluorinated ethylenepropylene (FEP) and perfluoroalkoxypolymers (PFA's).

5. The communications cable according to claim 1 additionally including a jacket surrounding said conductor and said layer of insulating material.

6. The communications cable according to claim 5 wherein said jacket is selected from the group consisting of fluorinated polymers, polyvinylchloride, and polyvinylchloride polymer alloys.

7. The communications cable according to claim 1 wherein the residual decomposition products include barium.

8. A communications cable comprising at least one pair of twisted wires, each wire thereof surrounded by a layer of insulating material, said insulating material comprising a chemically blown fluorinated polymer having a melting point of greater than about 480° F. and residual decomposition products of a 5-phenyltetrazole salt.

9. The communications cable according to claim 8 wherein said fluorinated polymer is selected from the group consisting of fluorinated ethylenepropylene (FEP) and perfluoroalkoxypolymers (PFA's).

10. The communications cable according to claim 8 additionally including a jacket surrounding said pair of twisted wires.

11. The communications cable according to claim 8 further comprising at least one additional pair of insulated wires, each wire of said at least one additional pair having a conductor surrounded by a layer of non-fluorinated insulating material.

12. The communications cable according to claim 11 wherein said layer of non-fluorinated insulating material is a polyolefin material.

13. The communications cable according to claim 8 wherein the residual decomposition products include barium.

14. A communications cable comprising at least one pair of twisted wires, each wire thereof surrounded by a layer of insulating material having a thickness of less than about 25 mil and comprising chemically blown fluorinated ethylene-propylene and residual decomposition products of the barium salt of 5-phenyltetrazole.

15. A communications cable comprising a plurality of pairs of twisted conductors, each conductor thereof comprising an electrical wire of 18 to 26 AWG gauge size and a surrounding layer of insulating material, the insulating material for at least one of said pairs of twisted conductors having a thickness of less than 25 mil and comprising a chemically blown fluorinated polymer having a melting point of greater than about 480° F. and residual decomposition products of the barium salt of 5-phenyltetrazole, and a jacket surrounding said plurality of pairs.

16. The communications cable according to claim 15, wherein the insulating material for at least one other of said pairs is a nonfluorinated insulating material.

17. An insulated wire comprising a conductor surrounded by a layer of insulating material, said insulating material comprising a chemically blown fluorinated polymer having a melting point of greater than about 480° F. and residual decomposition products of a 5-phenyltetrazole salt.

18. The insulated wire according to claim 17 wherein said fluorinated polymer is selected from the group consisting of fluorinated ethylene-propylene (FEP) and perfluoroalkoxypolymers (PFA's).

19. The insulated wire according to claim 17 wherein the residual decomposition products include barium.

* * * * *